US009151087B2

(12) United States Patent
Akizuki et al.

(10) Patent No.: US 9,151,087 B2
(45) Date of Patent: Oct. 6, 2015

(54) VEHICLE DOOR LOCK DEVICE

(75) Inventors: Ryujiro Akizuki, Novi, MI (US); Takashi Nishio, Kariya (JP); Nobuko Watanabe, Anjo (JP); Yasuhiko Sono, Hekinan (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 239 days.

(21) Appl. No.: 13/882,846

(22) PCT Filed: Oct. 4, 2011

(86) PCT No.: PCT/JP2011/073285

§ 371 (c)(1), (2), (4) Date: Jul. 18, 2013

(87) PCT Pub. No.: WO2012/060183

PCT Pub. Date: May 10, 2012

(65) Prior Publication Data

US 2013/0285389 A1 Oct. 31, 2013

(30) Foreign Application Priority Data

Nov. 4, 2010 (JP) ..... 2010-247437

(51) Int. Cl.
*E05C 3/16* (2006.01)
*E05B 83/36* (2014.01)
*E05B 85/02* (2014.01)

(52) U.S. Cl.
CPC ..... *E05B 83/36* (2013.01); *E05B 85/02* (2013.01); *Y10T 292/0949* (2015.04)

(58) Field of Classification Search
CPC ..... E05B 79/00; E05B 79/02; E05B 79/08; E05B 83/36; E05B 85/02; E05B 15/04; E05B 2015/0437; Y10T 292/0949
USPC ..... 292/100, 216, 201, DIG. 23, DIG. 53, 292/DIG. 54, DIG. 61, DIG. 64
See application file for complete search history.

(56) References Cited

U.S. PATENT DOCUMENTS 3,876,238 A * 4/1975 Watermann ..... 292/216
4,647,092 A * 3/1987 Nakamura ..... 292/216

(Continued)

FOREIGN PATENT DOCUMENTS

EP 1813746 A1 8/2007
JP 2002-129810 A 5/2002

OTHER PUBLICATIONS

U.S. Appl. No. 13/579,181, filed Aug. 29, 2012, Ryujiro Akizuki et al.

(Continued)

*Primary Examiner* — Kristina Fulton
*Assistant Examiner* — Christine M Mills
(74) *Attorney, Agent, or Firm* — Buchanan Ingersoll & Rooney PC

(57) ABSTRACT

A vehicle door lock device includes a latch mechanism having a latch and a pawl, and a lock mechanism having an open lever linked with the pawl. The lock mechanism is combined with the latch mechanism. A latch-side axial support portion is provided in a latch housing of the latch mechanism. The latch-side axial support portion rotatably supports a coil portion of a pawl spring for biasing the pawl toward a default position. A lock-side axial support portion is provided in a lock housing of the lock mechanism. The lock-side axial support portion rotatably supports a coil portion of an open lever spring for biasing the open lever toward a default position. At least part of the latch-side axial support portion overlaps with the lock-side axial support portion, so that pulling out of the open lever spring is prevented by means of the latch-side axial support portion.

9 Claims, 10 Drawing Sheets

(56) References Cited

U.S. PATENT DOCUMENTS

| | | | | |
|---|---|---|---|---|
| 4,667,991 | A * | 5/1987 | Pébre | 292/201 |
| 5,749,611 | A * | 5/1998 | Watson et al. | 292/336.3 |
| 5,961,164 | A * | 10/1999 | Gomi | 292/216 |
| 6,131,967 | A * | 10/2000 | Kondo et al. | 292/201 |
| 7,390,034 | B2 * | 6/2008 | Inoue | 292/10 |
| 7,614,670 | B2 * | 11/2009 | Hayakawa et al. | 292/216 |
| 2008/0048458 | A1 | 2/2008 | Suzumura et al. | |
| 2009/0212577 | A1 * | 8/2009 | Fukunaga et al. | 292/216 |

OTHER PUBLICATIONS

U.S. Appl. No. 13/882,442, filed Aug. 29, 2013, Ryujiro Akizuki et al.
International Search Report (PCT/ISA/210) issued on Feb. 8, 2012, by the European Patent Office as the International Searching Authority for International Application No. PCT/JP2011/073285.
Written Opinion (PCT/ISA/237) issued on Feb. 8, 2012, by the Japanese Patent Office as the International Searching Authority for International Application No. PCT/JP2011/073285.

* cited by examiner

Vehicle exterior direction ⟷ Vehicle interior direction

VEHICLE DOOR LOCK DEVICE

BACKGROUND OF THE INVENTION

1. Technical Field

The present invention relates to a vehicle door lock device for being capable of holding a vehicle door in a closed state relative to a body (a vehicle body) and locking the door.

2. Related Art

An example of a vehicle door lock device is disclosed in JP2002-129810A. The vehicle door lock device disclosed in JP2002-129810A includes a latch mechanism and a lock mechanism. The latch mechanism includes a latch and a pawl, and is adapted to be capable of holding the vehicle door in a closed state relative to the body. The lock mechanism includes an open lever linked with the pawl, and combines with the latch mechanism. This vehicle door lock device is assembled in the vehicle door. As is commonly known, the latch of the latch mechanism is capable of engaging with/disengaging from a striker assembled in the body, and the pawl of the latch mechanism is capable of holding/releasing the engagement of the latch with the striker.

In the vehicle door lock device disclosed in the aforementioned JP2002-129810A, a pawl spring (54) for biasing the pawl (52) toward a default position is provided in the latch mechanism, and an open lever spring (43b) for biasing the open lever (41) toward a default position is provided in the lock mechanism.

SUMMARY OF THE INVENTION

In the vehicle door lock device disclosed in the aforementioned JP2002-129810A, the pawl spring (54) and the open lever spring (43b) are disposed separately from each other, and a support pin (43a) for preventing pulling out of the open lever spring (43b) from the open lever (41) is held by means of a sub base plate (14) provided in the latch mechanism. This increases the size of the sub base plate (14), which in turn increases the size of the latch mechanism as a whole. Accordingly, it is an object of the present invention to reduce the size of a latch mechanism.

In order to achieve the aforementioned object, the present invention provides a vehicle door lock device that includes: a latch mechanism including a latch and a pawl, the latch mechanism adapted to be capable of holding a vehicle door in a closed state relative to a vehicle body; a lock mechanism including an open lever linked with the pawl so that the door can be locked, the lock mechanism combined with the latch mechanism; a latch-side axial support portion provided in a latch housing of the latch mechanism which rotatably supports a coil portion of a pawl spring for biasing the pawl toward a default position; and a lock-side axial support portion provided in a lock housing of the lock mechanism which rotatably supports a coil portion of an open lever spring for biasing the open lever toward a default position. Here, at least part of the latch-side axial support portion overlaps with the lock-side axial support portion so that pulling out of the open lever spring is prevented by means of the latch-side axial support portion.

In this case, it is preferable for the lock-side axial support portion and the latch-side axial support portion to be disposed off-center relative to each other, and for the pawl spring to be prevented from pulling out by means of the lock-side axial support portion.

Furthermore, the latch-side axial support portion may have a first cylinder portion capable of making contact with the inner circumferential surface of the coil portion of the pawl spring so as to support the coil portion of the pawl spring, an opposing surface that opposes the lock-side axial support portion on the side of the first cylinder portion that faces the lock mechanism, and a second cylinder portion that protrudes from the opposing surface toward the lock mechanism; and the lock-side axial support portion may have a cylinder portion capable of making contact with the inner surface of the coil portion of the open lever spring so as to support the coil portion of the open lever spring and that has a center line that is the same as a center line of the second cylinder portion, a fitting hole provided in the cylinder portion into which the second cylinder portion can be fitted, and a leading end surface located on the leading end side of the cylinder portion and capable of making contact with at least part of the coil portion of the pawl spring.

Furthermore, the vehicle door lock device may further include a connecting member for connecting the latch housing to the lock housing at the location of the center line of the second cylinder portion, with the lock-side axial support portion supporting the open lever rotatably on the outer circumferential surface of the cylinder portion.

Furthermore, the open lever spring may include one end portion that extends from one end of the coil portion and fits with the open lever, and the other end portion that extends from the other end of the coil portion and fits with a locking portion provided in the lock housing of the lock mechanism; and the open lever may be disposed between the lock housing and the open lever spring.

In the vehicle door lock device according to the present invention, at least part of the latch-side axial support portion overlaps with the lock-side axial support portion so that pulling out of the open lever spring is prevented by means of the latch-side axial support portion. Accordingly, it is not necessary to hold the open lever spring using a sub base plate of the latch mechanism. As a result, it is possible to reduce the whole size of the latch mechanism.

In addition, when carrying out the present invention as described above, the lock-side axial support portion and the latch-side axial support portion are disposed off-center relative to each other, and thus in the case where pulling out of the pawl spring is prevented by means of the lock-side axial support portion, rising upward of the pawl spring can be prevented by means of the lock-side axial support portion. Here, "off-center" means that the latch-side axial support portion and the lock-side axial support portion are disposed opposite to each other so that the axial direction of the latch-side axial support portion and the axial direction of the lock-side axial support portion are parallel to each other, and that when a cross-section of the latch-side axial support portion taken along the plane that is orthogonal to the axial direction thereof and a cross-section of the lock-side axial support portion taken along the plane that is orthogonal to the axial direction thereof are viewed from both of those axial directions, portions in which the cross-sections overlap and portions in which the cross-sections do not overlap are both present.

In addition, when carrying out the present invention as described above, in the case where the latch-side axial support portion has a first cylinder portion capable of making contact with the inner circumferential surface of the coil portion of the pawl spring so as to support the coil portion of the pawl spring, an opposing surface that opposes the lock-side axial support portion on the side of the first cylinder portion that faces the lock mechanism, and a second cylinder portion that protrudes from the opposing surface toward the lock mechanism, and the lock-side axial support portion has a cylinder portion capable of making contact with the inner surface of the coil portion of the open lever spring so as to support the coil portion of the open lever spring and that has a center line that is the same as a center line of the second cylinder portion, a fitting hole provided in the cylinder portion into which the second cylinder portion can be fitted, and a leading end surface located on the leading end side of the cylinder portion and capable of making contact with at least part of the coil portion of the pawl spring, rising upward of the pawl spring can be prevented by means of the leading end surface of the cylinder portion.

In addition, when carrying out the present invention as described above, in the case where the vehicle door lock device further includes a connecting member for connecting the latch housing to the lock housing at the location of the center line of the second cylinder portion, with the lock-side axial support portion supporting the open lever rotatably on the outer circumferential surface of the cylinder portion, the strength of the connection in the vicinity of the rotation axis of the open lever can be improved by matching the position of the connection created by the connecting member with the position of the rotation axis of the open lever.

In addition, when carrying out the present invention as described above, in the case where the open lever spring includes one end portion that extends from one end of the coil portion and fits with the open lever, and the other end portion that extends from the other end of the coil portion and fits with a locking portion provided in the lock housing of the lock mechanism, and the open lever is disposed between the lock housing and the open lever spring; fitting one end of the open lever spring to the open lever and fitting the other end of the open lever spring to the locking portion of the lock housing makes it possible to hold the open lever with the open lever spring and provisionally hold the open lever spring and the open lever in the lock housing. Therefore, the ease of assembly when combining the lock mechanism and the latch mechanism to configure the vehicle door lock device can be improved.

A vehicle door lock device according to the present invention may also be configured so as to include: a latch mechanism including a latch adapted to engage with or disengage from a striker assembled in a body of a vehicle when a door of the vehicle is opened and closed, a pawl adapted to hold or release the engagement of the latch with the striker, a latch housing for accommodating the latch and the pawl, a pawl spring having a coil portion for biasing the pawl, and a latch-side axial support portion provided in the latch housing so as to protrude toward the inner circumferential side of the coil portion of the pawl spring for rotatably supporting the coil portion of the pawl spring; and a lock mechanism including an open lever linked with the pawl, an open lever spring having a coil portion for biasing the open lever, a lock housing for accommodating the open lever and the open lever spring, and a lock-side axial support portion provided in the lock housing so as to protrude toward the inner circumferential side of the coil portion of the open lever spring for rotatably supporting the coil portion of the open lever spring, the lock mechanism being assembled to the latch mechanism. Here, the latch-side axial support portion has an opposing surface formed so as to oppose a leading end surface of the lock-side axial support portion, and the opposing surface includes a latch-side contact surface that makes contact with the leading end surface of the lock-side axial support portion, and a latch-side non-contact surface formed outward in the radial direction of the latch-side axial support portion from the latch-side contact surface without making contact with the leading end surface of the lock-side axial support portion.

In this case, the leading end surface of the lock-side axial support portion may include a lock-side contact surface that makes contact with the latch-side contact surface, and a lock-side non-contact surface formed outward in the radial direction of the lock-side axial support portion from the lock-side contact surface without making contact with the latch-side contact surface.

DETAILED DESCRIPTION OF THE INVENTION

Figure 1:
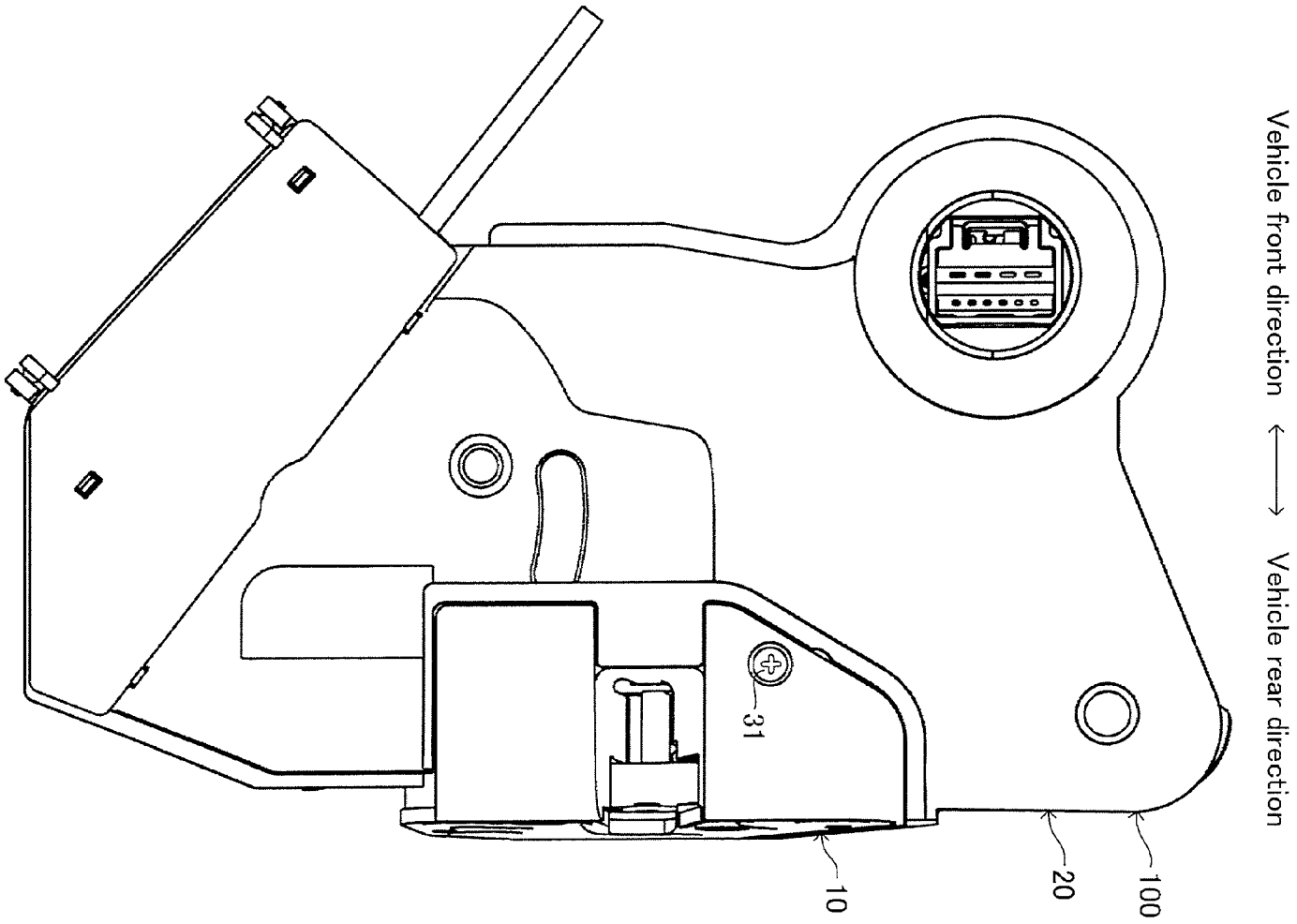
FIG. 1 is a side view illustrating an embodiment of a vehicle door lock device according to the present invention from the inside of a vehicle.
Figure 2:
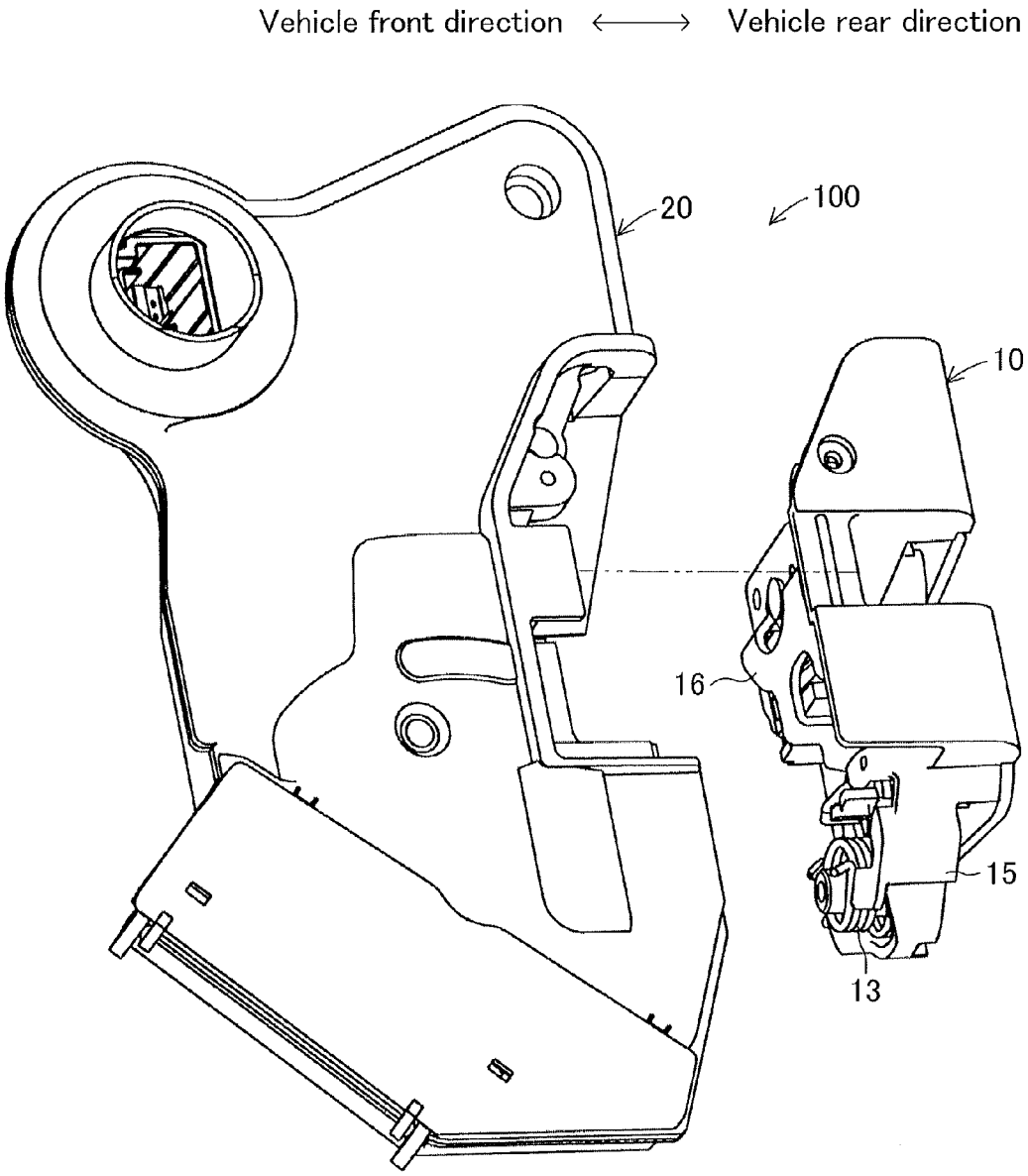
FIG. 2 is an exploded perspective view illustrating a state in which the vehicle door lock device shown in FIG. 1 has been divided into a lock mechanism and a latch mechanism.
Figure 3:
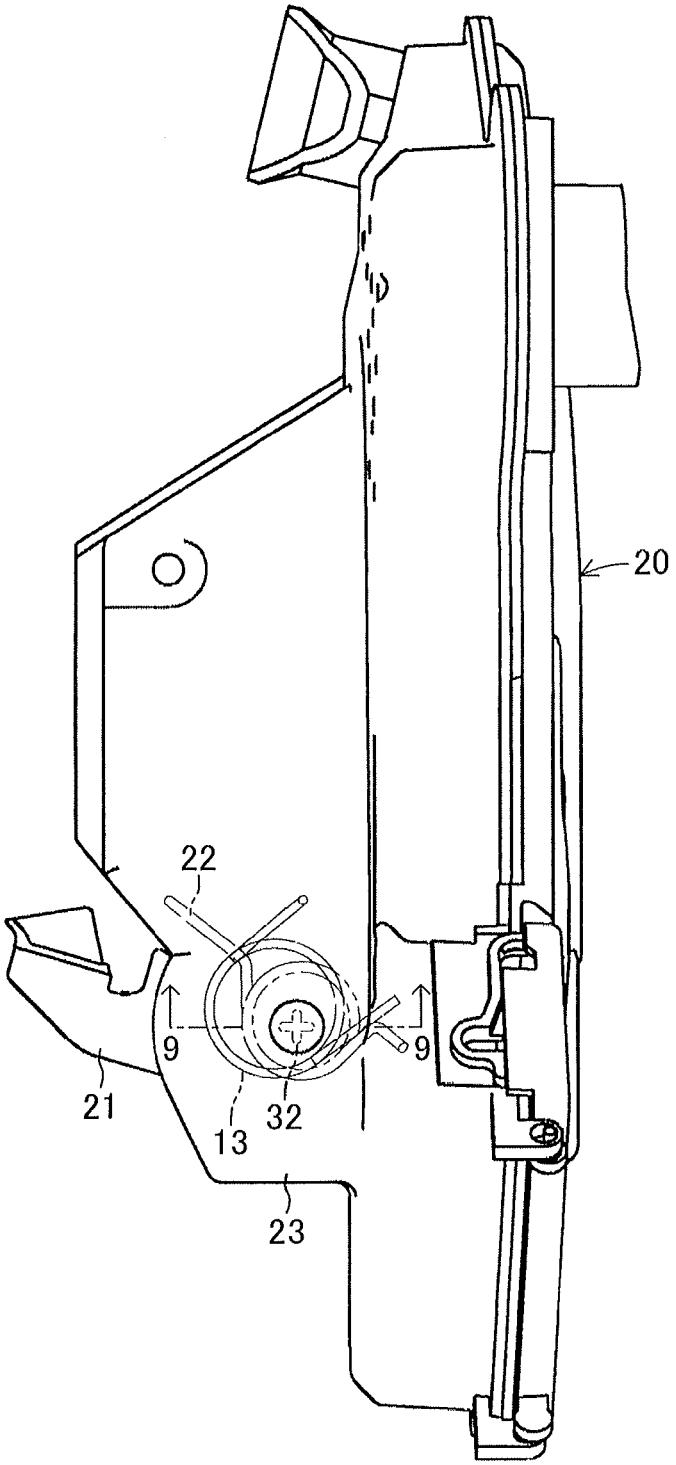
FIG. 3 is a front view illustrating the lock mechanism shown in FIG. 2 from the front side of the vehicle.
Figure 4:
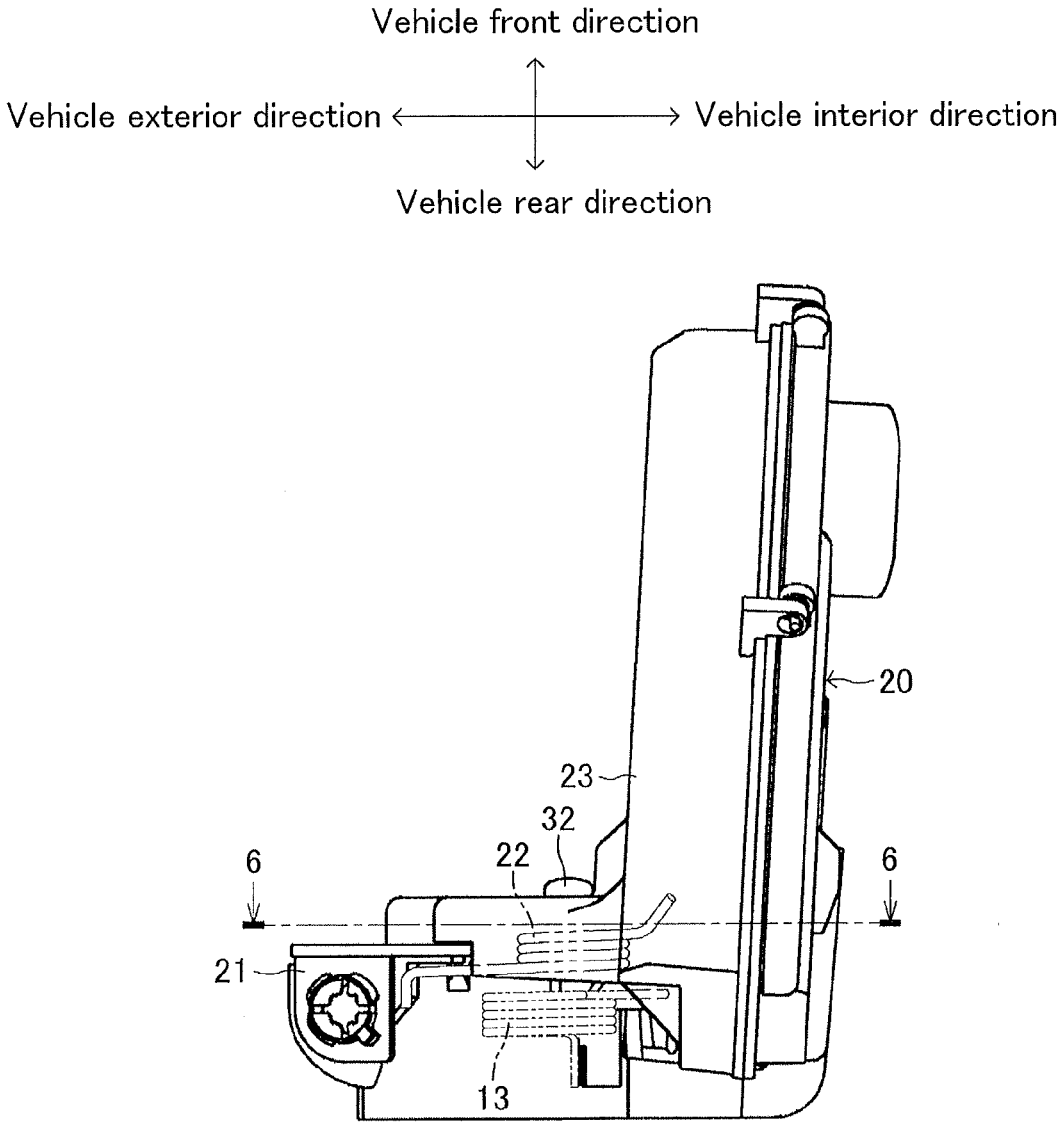
FIG. 4 is a bottom view illustrating the lock mechanism shown in FIG. 3 from below.

Hereinafter, an embodiment of the present invention will be described according to the drawings. FIG. 1 through FIG. 11 illustrate a vehicle door lock device 100 according to the present invention. The vehicle door lock device 100 is installed in a door (not shown) that is mounted on the front-right side of a vehicle. The vehicle door lock device 100 includes a latch mechanism 10 and a lock mechanism 20. The latch mechanism 10 and the lock mechanism 20 are connected to each other by two screws 31 and 32 (the screw 31 is indicated by a solid line in FIG. 1, and the screw 32 is indicated by a broken line in FIG. 3 and by a solid line in FIG. 4 and FIG. 9).

Figure 7:
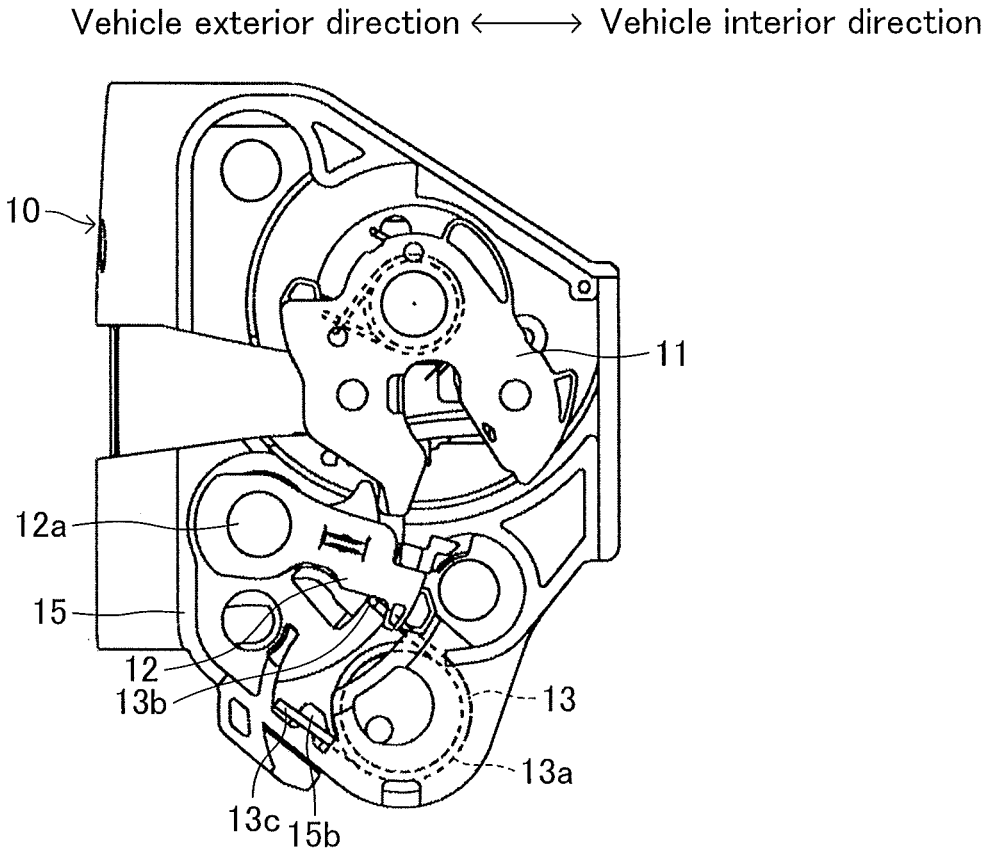
FIG. 7 is a diagram illustrating the internal configuration of the latch mechanism shown in FIG. 2.
Figure 8:
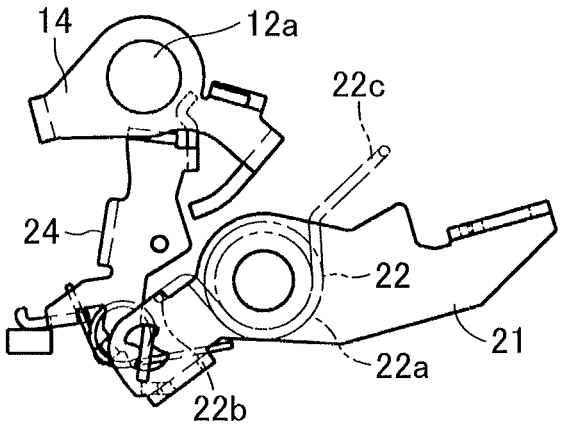
FIG. 8 is a diagram illustrating a relationship between an open lever, an open link, a lift lever, and so on shown in FIG. 5 and FIG. 6.

As is commonly known, the latch mechanism 10 is assembled in the door in order to hold the door in a closed state relative to a body (a vehicle body, which is not shown). As shown in FIG. 7, the latch mechanism 10 includes: a latch 11 that is capable of engaging with/disengaging from a striker (not shown) fixed to the body; a pawl 12 that is capable of engaging with/disengaging from the latch 11 to hold/release the engagement of the latch 11 with the striker; a pawl spring 13 for biasing the pawl 12 toward a default position (in the direction in which the pawl 12 can engage with the latch 11); a lift lever 14 (see FIG. 6 and FIG. 8) assembled on a rotation shaft 12*a* of the pawl 12 and that rotates integrally with the pawl 12; and a latch housing 15 for accommodating these elements. The door is held in a closed state relative to the body by the latch 11 engaging with the striker.

As is commonly known, the lock mechanism 20 is capable of holding or releasing the door into or from a locked state. As shown in FIG. 3 through FIG. 6 and in FIG. 8, the lock mechanism 20 includes: an open lever 21 linked with the pawl 12 of the latch mechanism 10; an open lever spring 22 for biasing the open lever 21 toward a default position; and a lock housing 23 for accommodating these elements. Note that the open lever 21 is configured so that an open link 24 assembled on the open lever 21 links with the pawl 12 of the latch mechanism 10 via the lift lever 14 of the latch mechanism 10. The position of the open link 24 is switched between a lock position and an unlock position by manipulating a lock knob or the like (not shown). By operating the open lever when the open link 24 is in the unlock position, the pawl 12 linked to the open link 24 moves against the biasing force of the pawl spring 13. As a result of the movement of the pawl 12, the engagement between the latch 11 and the striker is released and the door opens (that is, the locked state of the door is released). On the other hand, when the open link 24 is in the lock position, the link between the open link 24 and the pawl 12 is impeded. Thus, even if the open link 24 moves, the pawl does not move. Accordingly, the engagement between the latch 11 and the striker is not released (that is, the locked state of the door is maintained).

Figure 9:
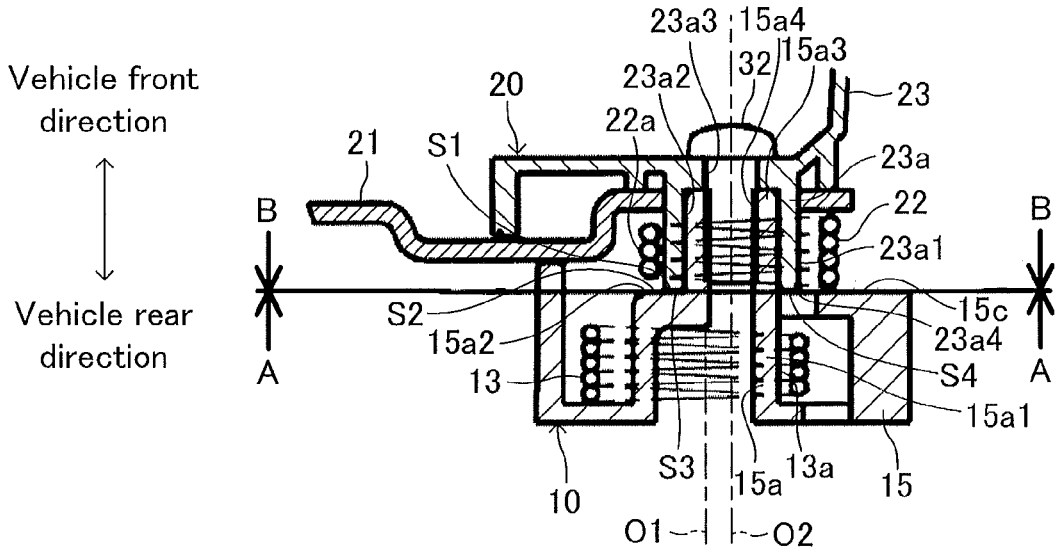
FIG. 9 is a cross-sectional view along the 9-9 line shown in FIG. 3.
Figure 10:
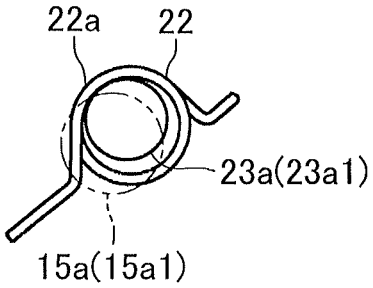
FIG. 10 is a diagram illustrating a relationship between an open lever spring, a lock-side axial support portion, a latch-side axial support portion, and so on, viewed along the A-A line shown in FIG. 9.
Figure 11:
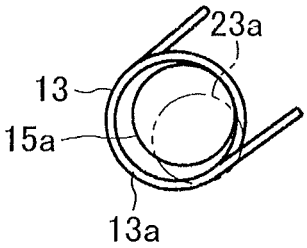
FIG. 11 is a diagram illustrating a relationship between a pawl spring, a latch-side axial support portion, a lock-side axial support portion, and so on, viewed along the B-B line shown in FIG. 9.

Incidentally, in this embodiment, a latch-side axial support portion 15*a* is provided in the latch housing 15 of the latch mechanism 10, as shown in FIG. 9 through FIG. 11. The latch-side axial support portion 15*a* is provided so as to protrude into the inner circumferential side of a coil portion 13*a* in the pawl spring 13, and rotatably supports the coil portion 13*a*. In addition, a lock-side axial support portion 23*a* is provided in the lock housing 23 of the lock mechanism 20. The lock-side axial support portion 23*a* is provided so as to protrude into the inner circumferential side of a coil portion 22*a* in the open lever spring 22, and rotatably supports the coil portion 22*a*. The lock-side axial support portion 23*a* and the latch-side axial support portion 15*a* are parallel in the axial direction, and cross-sectional external forms are circular. The lock-side axial support portion 23*a* and the latch-side axial support portion 15*a* are disposed off-center relative to each other, and are opposed in the axial direction of the screw 32. In other words, the lock-side axial support portion 23*a* and the latch-side axial support portion 15*a* are disposed eccentrically relative to each other while being opposed to each other. Furthermore, at least part of the latch-side axial support portion 15*a* overlaps with the lock-side axial support portion 23*a*, so that pulling out of the open lever spring 22 is prevented by means of the latch-side axial support portion 15*a* and pulling out of the pawl spring 13 is prevented by means of the lock-side axial support portion 23*a*.

The latch-side axial support portion 15*a* includes a first cylinder portion 15*a*1 whose outer circumferential surface is capable of making contact with part of the inner circumferential surface of the coil portion 13*a* of the pawl spring 13 to support the coil portion 13*a*. The cross-sectional external form of the first cylinder portion 15*a*1 is circular. In addition, an opposing surface 15*a*2 that opposes the lock-side axial support portion 23*a* is formed in the side of the first cylinder portion 15*a*1 that faces toward the lock mechanism 20. In other words, an end surface of the first cylinder portion 15*a*1 forms an opposing surface 15*a*2 that is opposed to the surface of the leading end of the lock-side axial support portion 23*a*. Furthermore, the latch-side axial support portion 15*a* includes a second cylinder portion 15*a*3 that protrudes from the opposing surface 15*a*2 toward the lock mechanism 20. The cross-sectional external form of the second cylinder portion 15*a*3 is circular. The external diameter of the second cylinder portion 15*a*3 is smaller than the external diameter of the first cylinder portion 15*a*1. A center line O2 of the second cylinder portion 15*a*3 is parallel to a center line O1 of the first cylinder portion 15*a*1 and off-center relative to the center line O1 by a predetermined amount, and a through-hole 15*a*4 into which the screw 32 is threaded is provided in the center thereof. Note that the cross-sectional external forms of the first cylinder portion 15*a*1 and the second cylinder portion 15*a*3 need not be circular, and may be elliptical instead, for example.

The lock-side axial support portion 23*a* includes a cylinder portion 23*a*1 whose outer circumferential surface is capable of making contact with part of the inner circumferential surface of the coil portion 22*a* of the open lever spring 22 to support the coil portion 22*a*. The cross-sectional external form of the cylinder portion 23*a*1 is circular, and the leading end of the cylinder portion 23*a*1 is open. In addition, the lock-side axial support portion 23*a* supports the open lever 21 rotatably on the outer circumferential surface of the cylinder portion 23*a*1. The center line O2 of the cylinder portion 23*a*1 is the same as the aforementioned center line O2 of the second cylinder portion 15*a*3. In addition, the cylinder portion 23*a*1 includes a fitting hole 23*a*2 into which the second cylinder portion 15*a*3 can fit. Furthermore, a through-hole 23*a*3, through which the screw 32 is passed, is provided in the lock-side axial support portion 23*a* in the base end area of the cylinder portion 23*a*1. The through-hole 23*a*3 is provided coaxially relative to the fitting hole 23*a*2.

After the second cylinder portion 15*a*3 has been fitted into the fitting hole 23*a*2, or in other words, after the second cylinder portion 15*a*3 has been inserted inside of the inner circumferential surface of the cylinder portion 23*a*1, the latch-side axial support portion 15*a* and the lock-side axial support portion 23*a* are connected as a single unit by threading the screw 32 into the through-hole 15*a*4. Connecting these elements as a single unit enhances the strength of the link in the vicinity of the rotation shaft of the open lever 21. In this state (the state shown in FIG. 9), the opposing surface 15*a*2 of the latch-side axial support portion 15*a* is capable of making contact with at least part of the coil portion 22*a* of the open lever spring 22. Specifically, the opposing surface 15*a*2 includes: a latch-side contact surface S1 that makes contact with a leading end surface 23*a*4 of the cylinder portion 23*a*1; and a latch-side non-contact surface S2 formed outward in the radial direction of the first cylinder portion 15*a*1 from the latch-side contact surface S1 without making contact with the leading end surface 23*a*4 of the cylinder portion 23*a*1. Accordingly, rising upward of the open lever spring 22 (that is, moving of the open lever spring 22 toward the latch mechanism 10) is prevented by means of at least part of the coil portion 22*a* of the open lever spring 22 making contact with the opposing surface 15*a*2 (the latch-side non-contact surface S2). In addition, the leading end surface 23*a*4 of the cylinder portion 23*a*1 of the lock-side axial support portion 23*a* is capable of making contact with at least part of the coil portion 13*a* of the pawl spring 13. Specifically, the leading end surface 23*a*4 of the cylinder portion 23*a*1 includes: a lock-side contact surface S3 that makes contact with the latch-side contact surface S1; and a lock-side non-contact surface S4 formed outward in the radial direction of the cylinder portion 23*a*1 from the lock-side contact surface S3 without making contact with the latch-side contact surface S1. Rising upward of the pawl spring 13 (that is, moving of the pawl spring 13 toward the lock mechanism 20) is prevented by means of at least part of the coil portion 13*a* of the pawl spring 13 making contact with the leading end surface 23*a*4 (the lock-side non-contact surface S4).

In addition, in this embodiment, the latch housing 15 is provided with a contact surface 15*c* that is capable of making contact with part of the coil portion 22*a* of the open lever spring 22. The contact surface 15*c* is formed along the same plane as the aforementioned opposing surface 15*a*2, and effectively prevents rising upward of the open lever spring 22 by working in tandem with the opposing surface 15*a*2. Note that the contact surface 15*c* need not be provided if the opposing surface 15*a*2 can prevent rising upward of the open lever spring 22 to a sufficient degree.

Figure 5:
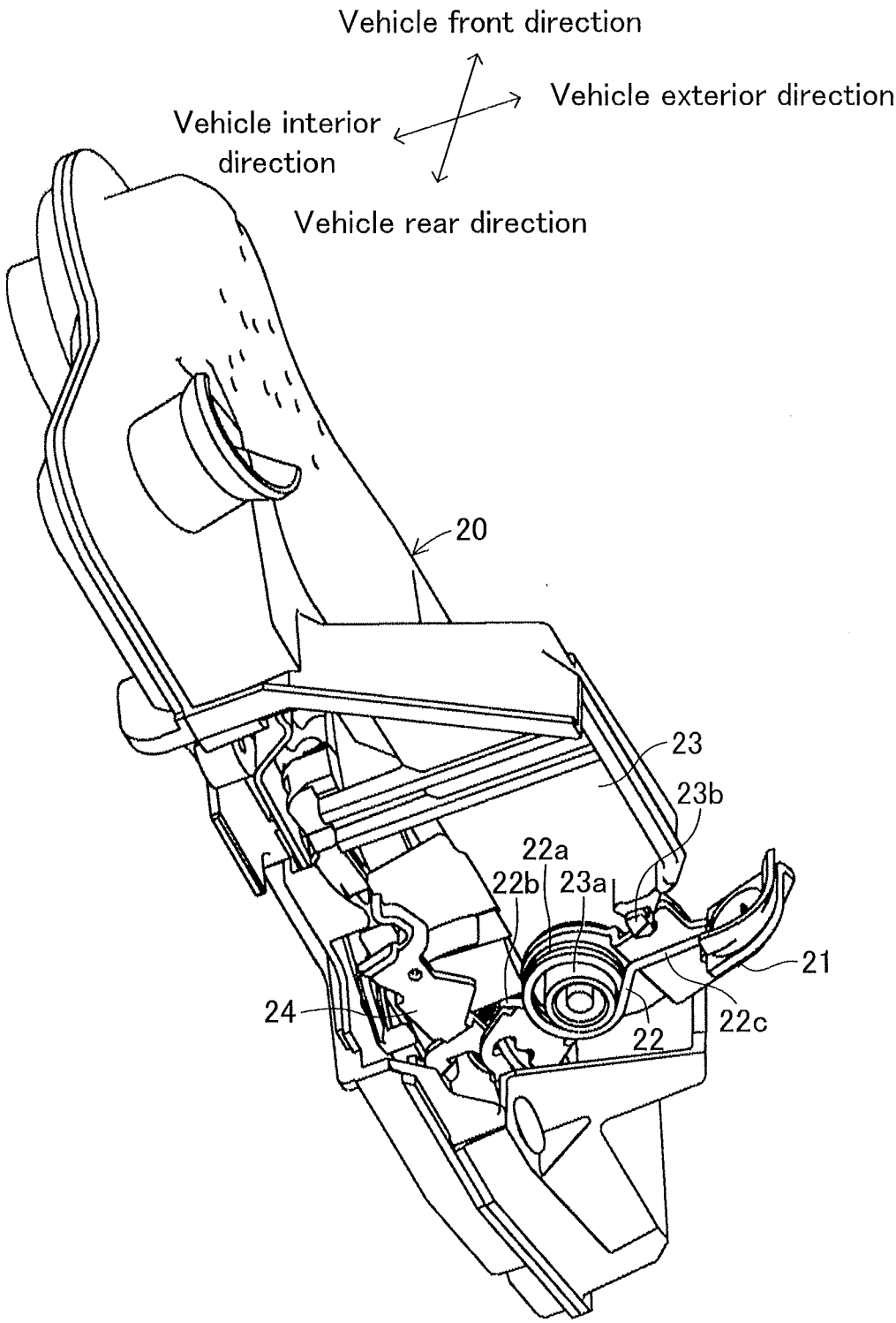
FIG. 5 is a perspective view illustrating the lock mechanism shown in FIG. 2 and FIG. 3 at an angle from below.
Figure 6:
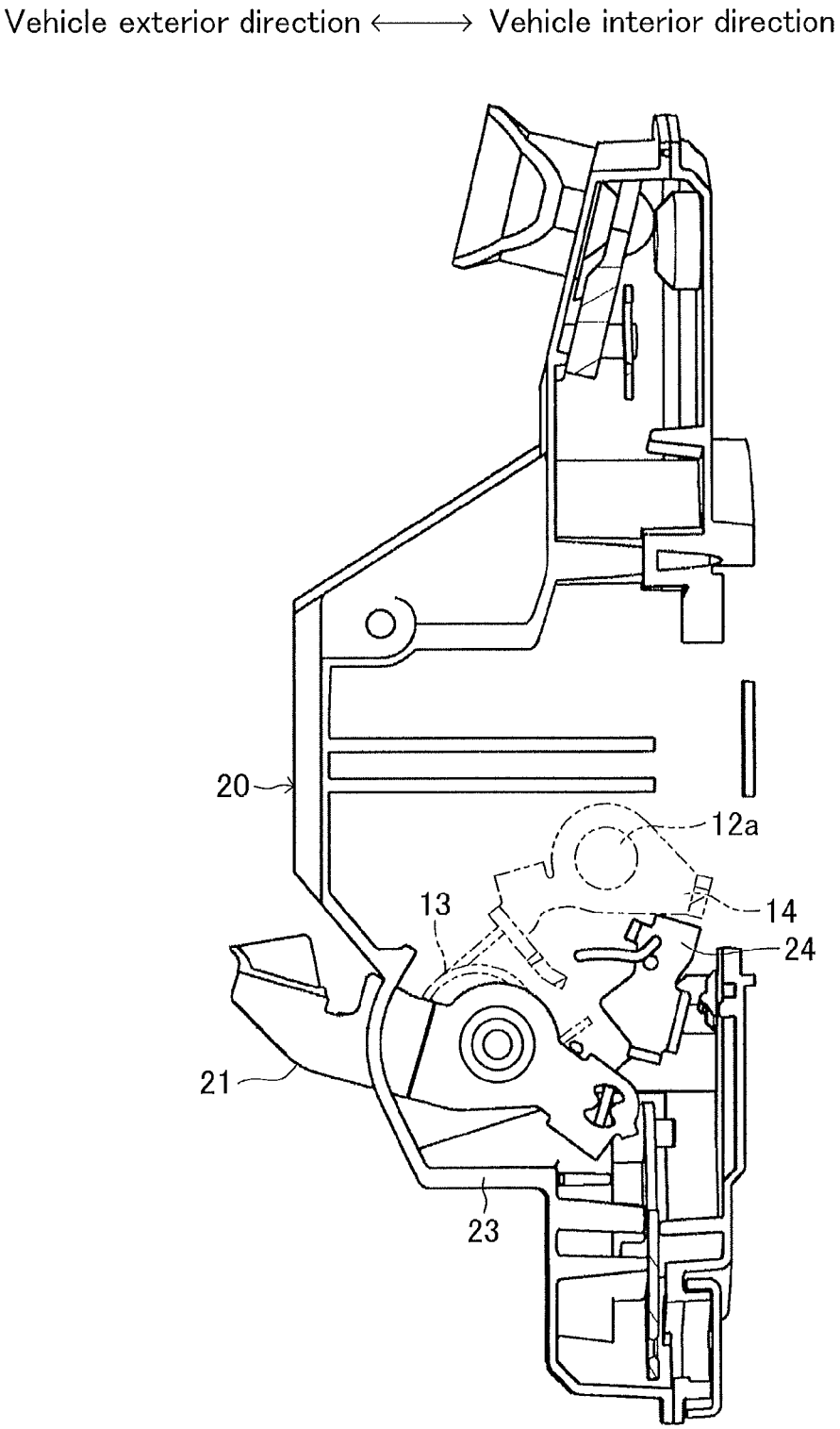
FIG. 6 is a cross-sectional view along the 6-6 line shown in FIG. 4.

Furthermore, as shown in FIG. 7, in this embodiment, the pawl spring 13 includes: a one end portion 13*b* that extends from one end of the coil portion 13*a* and fits with the pawl 12; and the other end portion 13*c* that extends from the other end of the coil portion 13*a* and fits with a locking portion 15*b* provided in the latch housing 15 of the latch mechanism 10. In addition, as shown in FIG. 5, the open lever spring 22 includes: one end portion 22*b* that extends from one end of the coil portion 22*a* and fits with the open lever 21; and the other end portion 22*c* that extends from the other end of the coil portion 22*a* and fits with a locking portion 23*b* provided in the lock housing 23 of the lock mechanism 20 (note that the other end portion 22*c* is not fitted with the locking portion 23*b* in FIG. 5). As shown in FIG. 5 and FIG. 9, the open lever 21 is disposed between the lock housing 23 and the open lever spring 22.

As shown in FIG. 10 and FIG. 11, in the embodiment as described above, at least part of the latch-side axial support portion 15*a* overlaps with the lock-side axial support portion 23*a*, so that pulling out of the open lever spring 22 is prevented by means of the latch-side axial support portion 15*a* (rising upward of the open lever spring 22 is prevented). Accordingly, it is not necessary to hold the open lever spring 22 using a sub base plate (not shown in the drawings) of the latch mechanism 10, which in turn makes it possible to reduce the whole size of the latch mechanism 10.

In the embodiment as described above, the lock-side axial support portion 23*a* and the latch-side axial support portion 15*a* are disposed off-center relative to each other, as shown in FIG. 10 and FIG. 11, and it is thus possible to prevent rising upward of the pawl spring 13 (the coil portion 13*a*) by means of the lock-side axial support portion 23*a*. Furthermore, as shown in FIG. 5, in the embodiment as described above, the open lever spring 22 includes one end portion 22*b* that extends from one end of the coil portion 22*a* and fits with the open lever 21, and the other end portion 22*c* that extends from the other end of the coil portion 22*a* and fits with a locking portion 23*b* provided in the lock housing 23 of the lock mechanism 20; and the open lever 21 is disposed between the lock housing 23 and the open lever spring 22. Accordingly, the open lever 21 can be held by means of the open lever spring 22 by fitting the one end portion 22*b* of the open lever spring 22 with the open lever 21 and by fitting the other end portion 22*c* of the open lever spring 22 with the locking portion 23*b* of the lock housing 23. This makes it possible for the open lever spring 22 and the open lever 21 to be provisionally held in the lock housing 23. Therefore, the ease of assembly when combining the lock mechanism 20 and the latch mechanism 10 to configure the vehicle door lock device 100 can be improved.

As shown in FIG. 9 through FIG. 11, in the embodiment as described above, the cylinder portion 23*a*1 and the first cylinder portion 15*a*1 are disposed so that part of the external form of the cylinder portion 23*a*1 of the lock-side axial support portion (that is, the leading end surface 23*a*4) is eccentric (off-center) relative to the first cylinder portion 15*a*1 of the latch-side axial support portion 15*a*, so as to be shifted outward in the radial direction beyond the outer circumference of the first cylinder portion 15*a*1. However, when carrying out the present invention, the lock-side axial support portion 23*a* and the latch-side axial support portion 15*a* may be disposed off-center relative to each other so that the cylinder portion 23*a*1 of the lock-side axial support portion 23*a* is off-center within the range of the external form of the first cylinder portion 15*a*1 of the latch-side axial support portion 15*a*. In this case, it is preferable to form a portion that prevents rising upward of the pawl spring 13 in the latch housing 15.

In addition, when carrying out the present invention, the cylinder portion 23*a*1 of the lock-side axial support portion 23*a* and the first cylinder portion 15*a*1 of the latch-side axial support portion 15*a* may coaxially be disposed. In this case, the configuration may be such that the external diameter of the cylinder portion 23*a*1 is set to be smaller than the external diameter of the first cylinder portion 15*a*1, and part of the latch-side axial support portion 15*a* overlaps with the lock-side axial support portion 23*a* while the other parts of the latch-side axial support portion 15*a* do not overlap with the lock-side axial support portion 23*a* (in other words, the configuration may be such that part of the latch-side axial support portion 15*a* makes contact with the lock-side axial support portion 23*a* and the other parts of the latch-side axial support portion 15*a* protrudes from the latch-side axial support portion 15*a* in the radial direction thereof without making contact with the latch-side axial support portion 15*a*), and may be such that pulling out of the open lever spring 22 is prevented by means of the opposing surface 15*a*2 of the latch-side axial support portion 15*a*. In this case, too, it is preferable to form a portion that prevents rising upward of the pawl spring 13 in the latch housing 15.

Although in the embodiment as described above, the present invention is implemented as the vehicle door lock device 100 that is installed in a door (not shown) that is mounted on the front-right side of a vehicle, it goes without saying that the present invention can likewise be implemented as a vehicle door lock device that is installed in a door that is mounted in the front-left side of a vehicle and as a vehicle door lock device that is installed in a door that is mounted in the rear-right side or the rear-left side of a vehicle, and that the present invention can also be modified in various ways.

The invention claimed is:

1. A vehicle door lock device comprising:

a latch mechanism including a latch and a pawl, the latch mechanism adapted to be capable of holding a vehicle door in a closed state relative to a vehicle body;

a lock mechanism including an open lever linked with the pawl so that the door can be locked, the lock mechanism combined with the latch mechanism;

a latch-side axial support portion provided in a latch housing of the latch mechanism which rotatably supports a coil portion of a pawl spring for biasing the pawl toward a default position; and a lock-side axial support portion provided in a lock housing of the lock mechanism which rotatably supports a coil portion of an open lever spring for biasing the open lever toward a default position, wherein at least part of the latch-side axial support portion overlaps with the lock-side axial support portion so that pulling out of the open lever spring is prevented by means of the latch-side axial support portion, and the lock-side axial support portion and the latch-side axial support portion are disposed off-center relative to each other, and pulling out of the pawl spring is prevented by means of the lock-side axial support portion.

2. The vehicle door lock device according to claim 1, wherein the latch-side axial support portion includes a first cylinder portion capable of making contact with an inner circumferential surface of the coil portion of the pawl spring so as to support the coil portion of the pawl spring, an opposing surface that opposes the lock-side axial support portion on a side of the first cylinder portion that faces the lock mechanism, and a second cylinder portion that protrudes from the opposing surface toward the lock mechanism; and the lock-side axial support portion includes a cylinder portion capable of making contact with an inner surface of the coil portion of the open lever spring so as to support the coil portion of the open lever spring, the cylinder portion having a center line that is the same as a center line of the second cylinder portion, a fitting hole provided in the cylinder portion into which the second cylinder portion can be fitted, and a leading end surface located on a leading end side of the cylinder portion and capable of making contact with at least part of the coil portion of the pawl spring.

3. The vehicle door lock device according to claim 2, further comprising:

a connecting member for connecting the latch housing to the lock housing at the location of the center line of the second cylinder portion, wherein the lock-side axial support portion supports the open lever rotatably on the outer circumferential surface of the cylinder portion.

4. The vehicle door lock device according to claim 1, wherein the open lever spring includes one end portion that extends from one end of the coil portion and fits with the open lever, and another end portion that extends from another end of the coil portion and fits with a locking portion provided in the lock housing of the lock mechanism; and the open lever is disposed between the lock housing and the open lever spring.

5. A vehicle door lock device comprising:

a latch mechanism including a latch adapted to engage with or disengage from a striker assembled in a body of a vehicle when a door of the vehicle is opened and closed, a pawl adapted to hold or release the engagement of the latch with the striker, a latch housing for accommodating the latch and the pawl, a pawl spring having a coil portion for biasing the pawl, and a latch-side axial support portion provided in the latch housing so as to protrude toward an inner circumferential side of the coil portion of the pawl spring for rotatably supporting the coil portion of the pawl spring; and a lock mechanism including an open lever linked with the pawl, an open lever spring having a coil portion for biasing the open lever, a lock housing for accommodating the open lever and the open lever spring, and a lock-side axial support portion provided in the lock housing so as to protrude toward an inner circumferential side of the coil portion of the open lever spring for rotatably supporting the coil portion of the open lever spring, the lock mechanism being assembled to the latch mechanism, wherein the latch-side axial support portion has an opposing surface formed so as to oppose a leading end surface of the lock-side axial support portion;

the opposing surface includes a latch-side contact surface that makes contact with the leading end surface of the lock-side axial support portion, and a latch-side non-contact surface formed outward in the radial direction of the latch-side axial support portion from the latch-side contact surface without making contact with the leading end surface of the lock-side axial support portion; and the latch-side axial support portion and the lock-side axial support portion are disposed eccentrically relative to each other while being opposed to each other.

6. The vehicle door lock device according to claim 5, wherein the leading end surface of the lock-side axial support portion includes a lock-side contact surface that makes contact with the latch-side contact surface, and a lock-side non-contact surface formed outward in the radial direction of the lock-side axial support portion from the lock-side contact surface without making contact with the latch-side contact surface.

7. The vehicle door lock device according to claim 5, wherein the latch-side axial support portion includes a first cylinder portion having a side surface contacted with the inner circumferential surface of a coil portion of the pawl spring and an opposing surface on a side of the first cylinder portion that faces the lock mechanism, and a second cylinder portion formed so as to protrude from the opposing surface and having a smaller external diameter than an external diameter of the first cylinder portion;

the lock-side axial support portion includes a cylinder portion formed so as to protrude from the lock housing, the cylinder portion having a side surface contacted with the inner circumferential surface of the coil portion of the open lever spring and a leading end which is opened, and disposed coaxially with the second cylinder portion; and the second cylinder portion is inserted into the inside of the cylinder portion from the leading end of the cylinder portion.

8. The vehicle door lock device according to claim 7, wherein a base end of the cylinder portion is open;

a linking member is inserted toward the inside of the second cylinder portion from the open base end of the cylinder portion; and the latch housing and the lock housing are linked by the linking member.

9. The vehicle door lock device according to claim 8, wherein the lock-side axial support portion supports the open lever in a freely-rotatable state on an outer circumferential surface of the cylinder portion.

* * * * *